US007970325B2

(12) United States Patent
Suzuki et al.

(10) Patent No.: US 7,970,325 B2
(45) Date of Patent: Jun. 28, 2011

(54) TRANSFER FIXING MEMBER, TRANSFER FIXING DEVICE AND IMAGE FORMING APPARATUS

(75) Inventors: Kazumi Suzuki, Shizuoka (JP); Takashi Fujita, Yokohama (JP); Hiromitsu Takagaki, Yokohama (JP); Takashi Seto, Yokohama (JP); Shin Kayahara, Yokohama (JP); Atsushi Nagata, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 517 days.

(21) Appl. No.: 12/164,921

(22) Filed: Jun. 30, 2008

(65) Prior Publication Data

US 2009/0016786 A1 Jan. 15, 2009

(30) Foreign Application Priority Data

Jul. 9, 2007 (JP) ..... 2007-179434

(51) Int. Cl.
*G03G 15/16* (2006.01)

(52) U.S. Cl. ..... 399/307

(58) Field of Classification Search ..... 399/148, 399/307

See application file for complete search history.

(56) References Cited

U.S. PATENT DOCUMENTS 6,542,705 B2 4/2003 Fujita et al.
6,559,421 B1 5/2003 Yura et al.
6,631,253 B2 10/2003 Nakafuji et al.
6,636,718 B2 10/2003 Yura et al.
6,646,227 B2 11/2003 Yura et al.
6,795,676 B2 9/2004 Kikuchi et al.
6,795,678 B2 9/2004 Yura et al.
6,847,792 B2 1/2005 Nakafuji et al.
6,941,088 B2 9/2005 Atsushi et al.
6,957,036 B2 10/2005 Kikuchi et al.
7,010,255 B2 3/2006 Yura et al.
7,010,257 B2 3/2006 Someya et al.
7,031,648 B2 4/2006 Takashi et al.
7,058,330 B2 6/2006 Nakafuji et al.
7,107,681 B2 9/2006 Yura et al.
7,127,202 B2 10/2006 Fujita et al.
7,139,520 B2 11/2006 Echigo et al.
7,177,580 B2 2/2007 Nakafuji et al.
7,224,928 B2 5/2007 Kikuchi et al.

(Continued)

FOREIGN PATENT DOCUMENTS

JP 2903972 3/1999

(Continued)

*Primary Examiner* — David M Gray
*Assistant Examiner* — Gregory H Curran
(74) *Attorney, Agent, or Firm* — Oblon, Spivak, McClelland, Maier & Neustadt, L.L.P.

(57) ABSTRACT

A transfer fixing member containing a base, and an outermost surface layer composed of an elastic material in which a conductive material is dispersed, wherein when a pressure applied to a surface of the transfer fixing member by making a toner image bearing member in contact with the transfer fixing member upon transferring of a toner image on the toner image bearing member onto the transfer fixing member is 0.2 kg/cm$^2$ to 2.0 kg/cm$^2$, the transfer fixing member has a volume resistance of $10^6$ Ω·cm or more to less than $10^{12}$ Ω·cm, and when a pressure applied to the surface of the transfer fixing member by making the transfer fixing member in contact with the recording medium located between the transfer fixing member and a pressurizing member upon transfer-fixing of the toner image onto the recording medium is 3.0 kg/cm$^2$ to 20 kg/cm$^2$, the transfer fixing is member has a volume resistance of less than $10^6$ Ω·cm.

6 Claims, 6 Drawing Sheets

U.S. PATENT DOCUMENTS

| | | | | |
|---|---|---|---|---|
| 7,233,762 | B2 | 6/2007 | Kunii et al. | |
| 7,251,429 | B2 | 7/2007 | Nakafuji et al. | |
| 7,254,362 | B2 | 8/2007 | Kikuchi et al. | |
| 7,269,384 | B2 | 9/2007 | Someya et al. | |
| 7,299,003 | B2 | 11/2007 | Kurotaka et al. | |
| 7,333,760 | B2 | 2/2008 | Baba et al. | |
| 7,346,305 | B2 | 3/2008 | Kikuchi et al. | |
| 7,359,666 | B2 | 4/2008 | Takashi et al. | |
| 7,369,803 | B2 | 5/2008 | Echigo et al. | |
| 7,706,732 | B2 * | 4/2010 | Kamei et al. | 399/307 |
| 2005/0158075 | A1 | 7/2005 | Echigo et al. | |
| 2005/0254846 | A1 | 11/2005 | Yura et al. | |
| 2006/0013624 | A1 | 1/2006 | Kurotaka et al. | |
| 2006/0019082 | A1 | 1/2006 | Kikuchi et al. | |
| 2006/0088349 | A1 | 4/2006 | Someya et al. | |
| 2007/0012676 | A1 | 1/2007 | Koide et al. | |
| 2007/0065188 | A1 | 3/2007 | Takagaki et al. | |
| 2007/0071511 | A1 | 3/2007 | Suzuki et al. | |
| 2007/0104520 | A1 | 5/2007 | Nakafuji et al. | |
| 2007/0212126 | A1 | 9/2007 | Seto et al. | |
| 2007/0212129 | A1 | 9/2007 | Takemoto et al. | |
| 2007/0218386 | A1 | 9/2007 | Suzuki et al. | |
| 2008/0008505 | A1 | 1/2008 | Seto et al. | |
| 2008/0069610 | A1 | 3/2008 | Nakafuji et al. | |

FOREIGN PATENT DOCUMENTS

| | | |
|---|---|---|
| JP | 3021352 | 1/2000 |
| JP | 3042414 | 3/2000 |
| JP | 2004-93864 | 3/2004 |
| JP | 2004-109687 | 4/2004 |
| JP | 2004-145260 | 5/2004 |
| JP | 2006-221066 | 8/2006 |
| JP | 2007-025096 | 2/2007 |

* cited by examiner

PRIOR ART

TRANSFER FIXING MEMBER, TRANSFER FIXING DEVICE AND IMAGE FORMING APPARATUS

BACKGROUND OF THE INVENTION

1. Field of the Invention

The present invention relates to a transfer fixing member, a transfer fixing device and an image forming apparatus using the transfer fixing device in a transfer fixing system, typified by copiers, printers, facsimile or complex machines thereof.

2. Description of the Related Art

Image forming apparatuses, in each of which an image is formed on an image bearing member by means of a developing unit, the image on the image bearing member is primarily transferred onto an intermediate transfer medium by means of a primary transfer unit, the image on the intermediate transfer medium is secondarily transferred onto a recording medium by means of a secondary transfer unit and the image on the recording medium is then fixed by means of a fixing unit, have been widely known. As the fixing unit, a pressurizing member is contacted with a fixing member containing a heat source inside, and the contact position is formed as a fixing nip where the recording medium is held and conveyed as well as heated. As the fixing members, rollers and belts are used, and as the pressurizing members, rollers, belts and fixed pads are used.

Images to be transferred include not only images of single color, but also of images of multi-color, such as full-color. Generally, a powder mainly consisting of a resin and having an electrostatic property, a so-called toner is used for forming images. With regard to fixing of these images, fixing property, particularly, temperature property in accordance with modes of images to be transferred is important. The temperature property affects heat transfer between a toner and a recording medium. The heat transfer direction changes depending on the temperature of a toner surface which is in contact with a fixing member and the temperature of a surface of a recording medium which is in contact with the toner (interface temperature). Of the temperature properties, the temperature of the toner surface affects glossiness required for a full-color image and the like. The temperatures of the toner and the surface of the recording medium in contact with the toner affect penetrance (adhesiveness) of the toner relative to the recording medium.

A fixing device of a full-color image forming apparatus is shown in FIG. 1. In the fixing device, image bearing members A to D capable of forming images of respective colors are arranged in parallel, and an intermediate transfer medium E, which corresponds to a primary transfer member and has an extended surface along the direction of the parallel arrangement, is disposed, and the images of respective colors are transferred sequentially to the intermediate transfer medium E. A transfer device F is disposed as a secondary transfer member for simultaneously transferring superimposedly transferred images to a recording medium so as to face and contact with the intermediate transfer medium E. And then, a recording paper on which images are simultaneously transferred is conveyed toward a fixing device G.

The fixing device G as shown in FIG. 1 has a configuration which employs a heat roller fixing system in which a fixing roller G1 and a pressurizing roller G2 face and contact with each other to form a fixing nip having a distance L, and an unfixed image on the recording paper is fixed by heat generated from the fixing roller G1. The heat roller fixing system is frequently used recently, as it is advantageous for achieving higher speed because of its high heat efficiency, for obtaining stable fixing efficiency because of its high heat transfer efficiency and for its simple structure because it is usable as a conveying medium for recording media.

A warming-up operation is performed in the fixing device G until the fixing nip reaches a predetermined temperature. In the case of a full-color image, approximately 1.5 times of heat quantity is required because the thickness of a superimposed toner image is thicker than that of a single-colored image such as black and white image. Thus, the heat quantity applied to the recording medium tends to increase, compared to the case when a single-colored image is formed. As a result, the recording medium is likely to be excessively heated, and when many full-color images are fixed at high speed, there is a possibility that electrical power for heating may become insufficient to sustain operation of the image formation with power capacity of power sources for business use such as 100V and 15 A, etc.

Excessive heating causes the recording medium itself to be excessively heated. Such phenomenon does not conform to the users' intention when handling recording media, and when a toner is softened again by excessively heating, stacked recording media are attached to each other, namely, stack on one another, resulting in poor workability, for example, the recording media have to be peeled off when being taken out. As for the failures due to excessive heating, when a recording medium such as the one of which surface is coated specially for preventing blurring is used for forming an image by mistake, instead of a recording medium such as a regular paper on which a toner is transferred, a coating material is transferred to a fixing member by heat, that is, offset is likely to occur, and smear or winding of recording media tend to occur at the fixing member. Thus, normally unnecessary operation for an image forming apparatus, such as removing the winding recording media or cleaning the fixing members, may be needed and it is disadvantageous in terms of workability.

In such a conventional image forming apparatus, image quality tends to be decreased in a step of transferring an image to a recording medium. In an apparatus which uses an electrophotographic method for image forming, images are transferred to a recording medium electrostatically by applying electric bias from the backside of the recording medium. In this case, a paper is mainly used as a recording medium. There are various papers, such as papers having various thicknesses, for example, a regular paper, cardboard and the like, and papers having surface properties of high quality, rough and the like. Because electric properties of the recording medium tend to change depending on the conditions such as hygroscopic property, thickness, surface property (irregularities), and the like of the recording medium, it is difficult to maintain constant transfer property when images on the image bearing member are transferred to the recording medium directly or through an intermediate transfer medium, and abnormal images are easily formed. Specifically in the case of a paper having rough surface property, because an intermediate transfer medium cannot follow the surface property of the paper, microscopic gaps are formed, where abnormal discharge occurs, and then an image is not transferred normally and a rough image is easily formed. Thus, as disclosed in Japanese Patent Application Laid-Open (JP-A) No. 2004-93864, a method of defining a surface roughness and elastic modulus of the outermost layer of an intermediate transfer medium so as to prevent from forming a microscopic gap is proposed. However, individual toner has a small particle diameter, compared to the irregularities of a surface of paper as a recording medium. Thus, toner scattering in intermediate transfer and image roughness may not be prevented depending on a surface roughness of a paper.

Next, images transferred to the recording medium are heated in a fixing device, and the temperatures differ in a toner layer thickness direction during fixing. In other words, in the case of the configuration as shown in FIG. 1, heating begins at a point where the images reach the fixing device G for the first time, and the temperature of the toner on the surface layer side opposite to the interface of the recording medium is considerably lower than that on the interface side of the recording medium in the toner thickness direction, thereby increasing temperature gradient in the toner thickness direction.

The fixing temperature may be increased in order to solve the above problem, however, when a heating temperature is increased, heating burden (increase in power consumption) increases, and the recording medium tends to be excessively heated as described above. Thus, problems caused by the excessively heated state of the recording medium or resoftening the toner are not solved.

Meanwhile, currently the image forming apparatuses in which all steps are performed stepwisely as mentioned above are the mainstream in the market. However, it is also known that an image forming apparatus which includes a so-called transfer fixing unit configured to perform a transfer step and fixing step simultaneously as disclosed in JP-B No. 3042414 and JP-A No. 2004-145260. JP-B No. 3042414 discloses an image forming apparatus in which an image is transfer-fixed from an intermediate transfer medium to a recording medium. JP-A No. 2004-145260 discloses an image forming apparatus in which an image is secondarily transferred and fixed from an intermediate transfer medium to a transfer fixing member, and then tertiarily transferred and fixed from the transfer fixing member to a recording medium. In these mentioned techniques, a powder mainly consisting of a resin and having an electrostatic property, a so-called toner is generally used for forming an image.

Because transferring and fixing are performed simultaneously in the image forming apparatus including the transfer fixing unit as described above, the degradation of image quality is least likely to occur even when a paper having rough surface property is used. This is because an image is simultaneously heated and transferred, and the toner is softened and melted by heat to become a viscoelastic block-shaped mass, making easy for the image to be transferred even in a microscopic gap of paper. Because of these advantages, the image forming apparatus having a transfer fixing unit is suitable for forming high quality images.

However, transfer fixing ratio is low and graininess is inappropriate for a highlight area in the transfer fixing step. In other words, it is known that a sufficient amount of toner is not easily transferred to a recording medium and images are not improved and sometimes may be poor, compared to normally-operated electrostatic-transfer system. Moreover, it has been found that when energy for transfer fixing is increased in order to improve the transfer fixing ratio and image quality of the highlight area. However, problems of nonuniformity in fixing and glossiness may occur in a high-density area containing a large amount of toner because the toner is excessively fixed, although the transfer fixing ratio is excellent even in the highlight area. Similar to the problem in transferring an image from the intermediate transfer medium to the paper, the problem occurs because the transfer fixing member does not sufficiently follow a paper surface, and a dot image at high-light do not contact with the paper, or contact therewith only in a small area.

Like the conventional image forming apparatus configured to perform a fixing step, in the image forming apparatus configured to perform a transfer fixing step, a photoconductor, intermediate transfer medium and transfer fixing member respectively need to have appropriate resistivities to perform electrostatic transfer. For example, when an insulator is used for the transfer fixing member, the transfer fixing member is charged, images are continuously transferred and appropriate electrostatic transfer cannot be performed.

According to JP-A No. 2004-93864, an appropriate range of a volume resistance of an intermediate transfer medium is $10^7$ Ω·cm to $10^{15}$ Ω·cm. An average volume resistance "RV" between an electrode which applies a primary transfer bias and a surface of an intermediate transfer belt is $10^7$ Ω·cm to $10^{13}$ Ω·cm, and an average resistance "RS" of the surface of the intermediate transfer belt is larger than RV. Thus, both high effective transfer and prevention of toner scattering in transferring can be improved. Moreover, both the high effective transfer and prevention of toner scattering in transferring can be improved on a further high level by making an average resistance "RS" of the back surface of the intermediate transfer belt higher than RV. A conductive material is dispersed to adjust the resistances.

However, when the conductive material is dispersed in the transfer fixing member so as to adjust its resistivity to an appropriate resistivity of the intermediate transfer medium, the conductive material dispersed therein causes offset in the transfer fixing member which is heated up to a fixing temperature of a toner in transfer fixing. Thus, it is difficult to adjust the resistance. It has been understood that an appropriate image cannot be obtained when images are continuously printed because the transfer fixing member is charged. Moreover, JP-B No. 3021352 and JP-A No. 2006-221066 are also related arts of the present invention.

BRIEF SUMMARY OF THE INVENTION

The present invention has been made in view of the problems in the conventional technologies described above, and is aimed to provide a transfer fixing member capable of obtaining high-quality and high-stability images even in a highlight area and high-density area, a transfer fixing device containing the transfer fixing member and an image forming apparatus containing the transfer fixing device, and the image forming apparatus can achieve high-speed fixing and energy conservation.

The means for solving the above problems are as follows:

<1> A transfer fixing member containing a base, and an outermost surface layer composed of an elastic material in which a conductive material is dispersed, wherein a toner image on a toner image bearing member is transferred onto the transfer fixing member by making the toner image bearing member in contact with the transfer fixing member, and the toner image is transfer-fixed onto a recording medium by making the transfer fixing member in contact with the recording medium which is located between the transfer fixing member and a pressurizing member, and wherein when a pressure applied to a surface of the transfer fixing member by making the toner image bearing member in contact with the transfer fixing member upon transferring of the toner image onto the transfer fixing member is 0.2 kg/cm$^2$ to 2.0 kg/cm$^2$, the transfer fixing member has a volume resistance of $10^6$ Ω·cm or more to less than $10^{12}$ Ω·cm, and when a pressure applied to the surface of the transfer fixing member by making the transfer fixing member in contact with the recording medium which is located between the transfer fixing member and the pressurizing member upon transfer-fixing of the toner image onto the recording medium is 3.0 kg/cm$^2$ to 20 kg/cm$^2$, the transfer fixing member has a volume resistance of less than $10^6$ Ω·cm.

<2> The transfer fixing member according to <1>, wherein the outermost surface layer has a storage elastic modulus E' of $5.0\times10^5$ Pa to $5.0\times10^6$ Pa and a loss elastic modulus E" of $5.0\times10^3$ Pa to $1.5\times10^5$ Pa at 60° C. to 200° C.

<3> The transfer fixing member according to <1>, wherein the elastic material is any one of a fluorosilicone rubber and fluorocarbon siloxane rubber.

<4> The transfer fixing member according to <1>, wherein a wax component contained in an oilless toner has a receding contact angle with the outermost surface layer of 55° or less at a transfer fixing temperature.

<5> A transfer fixing device containing the transfer fixing member according to any one of <1> to <4>, wherein a heating unit configured to heat at least the surface of the transfer fixing member, and the pressurizing member configured to form a nip with the transfer fixing member.

<6> An image forming apparatus containing the transfer fixing device according to <5>, wherein the toner image on the transfer fixing member is heated and melted by the heating unit, and then the melted toner image is simultaneously transferred and fixed on a recording medium which passes through the nip.

<7> An image forming method including transferring a toner image on a toner image bearing member onto a transfer fixing member by making the toner image bearing member in contact with the transfer fixing member, and transfer-fixing the toner image onto a recording medium by making the transfer fixing member in contact with the recording medium which is located between the transfer fixing member and a pressurizing member, wherein when a pressure applied to a surface of the transfer fixing member by making the toner image bearing member in contact with the transfer fixing member upon transferring of the toner image onto the transfer fixing member is 0.2 kg/cm$^2$ to 2.0 kg/cm$^2$, the transfer fixing member has a volume resistance of 10 Ω·cm or more to less than $10^{12}$ Ω·cm, and when a pressure applied to the surface of the transfer fixing member by making the transfer fixing member in contact with the recording medium which is located between the transfer fixing member and the pressurizing member upon transfer-fixing of the toner image onto the recording medium is 3.0 kg/cm$^2$ to 20 kg/cm$^2$, the transfer fixing member has a volume resistance of less than $10^6$ Ω·cm.

The transfer fixing member of the present invention can serve as a transfer fixing member, and can adjust its resistivity by increasing the number of contact points with the conductive material according to pressure applied thereto.

The transfer fixing device of the present invention which uses the transfer fixing member of the present invention can obtain a desired resistivity for electrostatic transfer when pressure is applied for intermediate transfer to the transfer fixing member, and can remove charge from the transfer fixing member that has been charged by electrostatic transfer by decreasing the resistivity when pressure is applied thereto for transfer fixing. Thus, the transfer fixing member cannot be charged and a stable image can be formed even when images are continuously printed.

The image forming apparatus of the present invention can achieve high-speed fixing and energy conservation by using the transfer fixing device of the present invention.

DETAILED DESCRIPTION OF THE INVENTION

Figure 1:
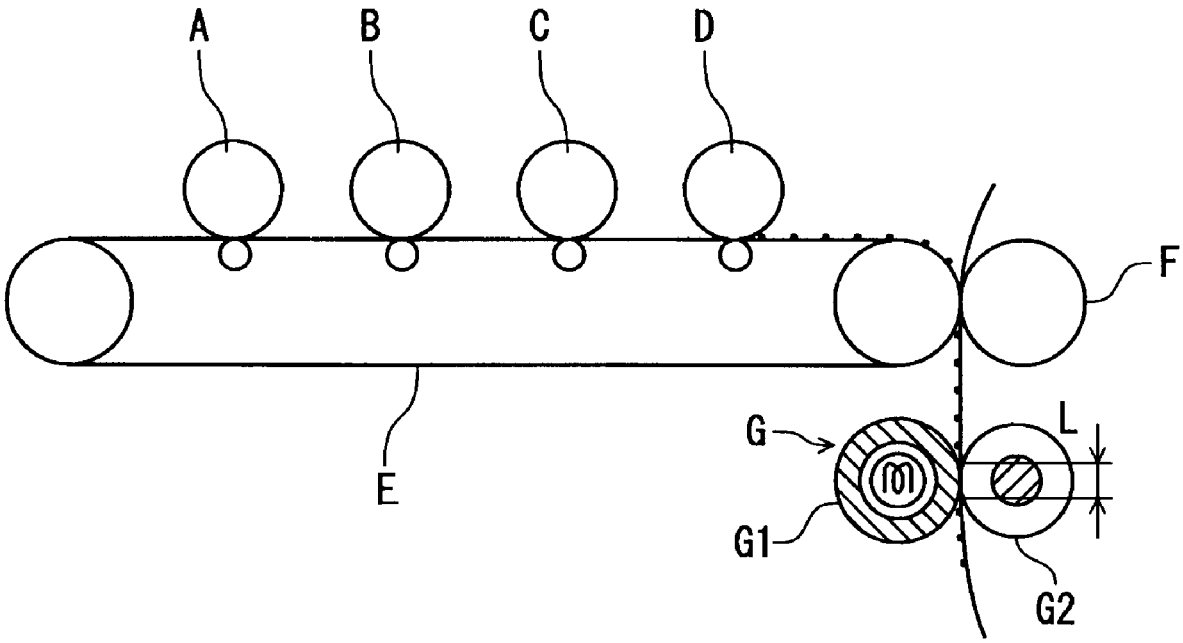
FIG. 1 is a schematic configuration showing an example of a substantial part of an image forming apparatus containing a conventional fixing device.

Hereinafter, a first embodiment of an image forming apparatus of the present invention will be explained.

First, with reference to FIG. 2, the outline of a configuration and operation of an exemplary tandem color copier as an image forming apparatus of this embodiment will be explained.

A color copier 100 contains an image forming unit 1A located in the center of the apparatus, a paper feed unit 1B located below the image forming unit 1A and an image reading unit (not shown) located above the image forming unit 1A.

In the image forming unit 1A, a transfer fixing belt 2A is arranged as an intermediate transfer medium having a transfer surface extended in a horizontal direction and a configuration for forming images of colors having complementary relations with colors for color separation is provided above the upper surface of the transfer fixing belt 2A. In other words, photoconductors 3Y, 3M, 3C and 3K as image bearing members which can bear images using toner of colors having complementary relations (yellow, magenta, cyan and black) are arranged in parallel along a transfer surface of the transfer fixing belt 2A.

Photoconductors, 3Y, 3M, 3C and 3K are formed in drum shapes and configured to be rotatable in the same direction (in counterclockwise direction), and charging devices 4Y, 4M, 4C and 4K which perform image forming process during rotation, writing devices 5Y, 5M, 5C and 5K as optical writing units, developing devices 6Y, 6M, 6C and 6K, primary transfer devices 7Y, 7M, 7C and 7K, and cleaning devices 8Y, 8M, 8C and 8K are respectively arranged around each of the photoconductors. The alphabets attached to respective reference numerals correspond to respective toner colors similar to the photoconductors 3Y, 3M, 3C and 3K. Each developing device 6Y, 6M, 6C and 6K contains a toner of each color.

The intermediate transfer belt is stretched around a driving roller 9 and driven rollers 10*a* and 10*b*, and configured to be movable in the same direction as the driving roller 9 and driven rollers 10*a* and 10*b* while facing the photoconductors 3Y, 3M, 3C and 3K. A cleaning device 11 configured to clean a surface of the transfer fixing belt 2A is disposed facing the driving roller 9 via the intermediate transfer belt.

A transfer fixing device 12A is disposed near the driven roller 10*a*. The transfer fixing device 12A contains a heating roller 30 as a heating member for heating the transfer fixing belt 2A and a pressurizing roller 14 as a pressurizing member or facing member, which forms a nip N (hereinafter referred to as a nip or fixing nip) with the heating roller 30. The heating roller 30 is formed of a metal such as aluminum and shaped in a pipe. Moreover, a halogen heater 15 is disposed in the heating roller 30 as a heating unit configured to heat the transfer fixing belt 2A.

The paper feed unit 1B contains a paper feed tray 16 which contains a recording paper P as a recording medium, a paper feed roller 17 which feeds paper by separating the recording papers P one by one from the uppermost paper in the paper feed tray 16, a pair of conveying rollers 18 which convey the fed recording paper P and a pair of resist rollers 19 by which the recording paper P is sent to the nip N at the timing in which a leading end of an image on the transfer fixing belt 2A and a predetermined position in a conveying direction agree with each other after the recording paper P is stopped temporarily to correct a diagonal misalignment.

In an image forming apparatus 100 of the present invention, a surface of the photoconductor 3Y is uniformly charged by the charging device 4Y and a latent electrostatic image is formed on the photoconductor 3Y according to the image information provided from the image reading unit. The latent electrostatic image is then made visible as a toner image by the developing device 6Y which contains a yellow toner. The toner image is primarily transferred onto the intermediate transfer belt by the primary transfer device 7Y, to which a predetermined bias is applied. The same image forming process as described above is performed on other photoconductors 3M, 3C and 3K, in which only colors of toners differ and toner images of respective colors are sequentially transferred onto the transfer fixing belt 2A by electrostatic force so as to be superimposed.

Next, the toner image T (hereinafter, also referred to as a toner), which is primarily transferred from each of the photoconductors 3Y, 3M, 3C and 3K to the transfer fixing belt 2A, is independently heated on the transfer fixing belt 2A which is heated by the heating roller 30 so as to be transferred and fixed on the recording paper P at the nip N. At this time, only the toner image T can be sufficiently heated in advance, thereby lowering a heating temperature, compared to that of the conventional system in which the toner image T and the recording paper P are heated simultaneously. The function of a wax as a releasing agent can be sufficiently obtained, because it takes a long time to expose the wax on the toner surface. Finally, the toner image T on the transfer fixing belt 2A is simultaneously transferred and fixed on the recording paper P at the nip N.

At this time, the transfer fixing belt 2A is charged, the heating roller 30 is made as a conductive roller and grounded to have a ground potential, and then contacted with the transfer fixing belt 2A to remove charge of the transfer fixing belt 2A. Alternatively, the surface of the pressurizing roller 14 is grounded to have a ground potential, thereby removing the charge of the transfer fixing belt 2A.

Residual toners on the photoconductors 3Y, 3M, 3C and 3K after image transfer are removed by the cleaning devices 8Y, 8M, 8C and 8K. Furthermore, electric potentials of the photoconductors 3Y, 3M, 3C and 3K are initialized by a charge removing lamp (not shown) to be ready for the next image forming process.

As described in Description of the Related Art, 1.5 times of heat quantity has been provided in conventional color image forming apparatuses as compared to black and white image forming apparatuses for the purpose of obtaining sufficient glossiness in consideration of temperature decrease caused by a recording paper. Thus, the recording paper is heated more than necessary, and adhesion property of the toner and the recording paper is also increased beyond necessity. On the other hand, in an image forming apparatus 1 in FIG. 2, in order to obtain sufficient glossiness, the temperature can be adjusted independently without consideration of the recording paper P, thus, it is possible to lower the temperature (fixing temperature) of the transfer fixing belt 2A. In addition, because the recording paper P is heated only at the fixing nip N, it is not excessively heated and adhesion property of the toner image T and the recording paper is not increased needlessly. Moreover, it is possible to fix at low temperature and shorten warm-up time, thereby enhancing energy conservation effect.

As described above, in this embodiment the transfer fixing device 12A itself has a function to bear a transferred unfixed toner image. It differs from a conventional fixing device by which a recording paper having an unfixed toner image is simply heated and pressurized, thereby being defined as a "transfer fixing device".

However, when an image is formed using the transfer fixing device which is used in the image forming apparatus of the present invention, the transfer fixing ratio is low and the graininess is poor in a highlight area. In other words, a toner is not sufficiently transferred to the recording medium and degradation in image quality is not suppressed as compared to the electrostatic transfer system which is commonly used, and the image is more adversely affected in some cases.

The cause of problems with the reproductivity of highlight images in a system that simultaneously transferring and fixing images is pursued, and it turns out that toner particles are unevenly distributed in a highlight area, unevenly distributed toner particles are hard to contact with surface irregularities of a recording paper as a recording medium, thus, the toner is not sufficiently transferred to the recording medium.

In order to obtain a high-quality highlight image using the simultaneously transferring and fixing system, it is important that a surface of a transfer fixing member follows surface irregularities of a paper so as to bring a toner image in which toner particles are unevenly distributed in a highlight area into contact sufficiently with the paper.

Figure 3:
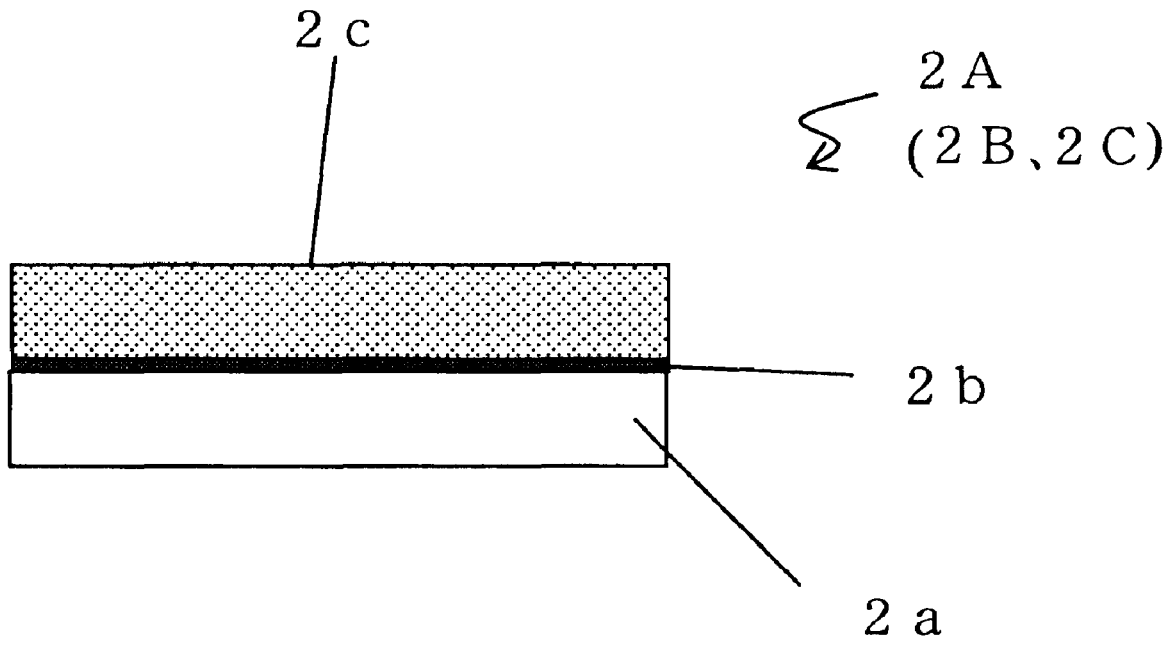
FIG. 3 is a cross-sectional view showing an example of a configuration of a transfer fixing member of the present invention.

Consequently, in the present invention, as shown in FIG. 3, a transfer fixing belt 2A as a transfer fixing member contains a base 2*a*, a primer layer 2*b* and a surface elastic layer 2*c* composed of an elastic material in which a conductive material is dispersed and has a certain thickness, wherein the surface elastic layer 2*c* is formed over a base 2*a* via the primer layer 2*b*. Thus, when the transfer fixing belt 2A is pressurized, contact points of the conductive material dispersed in the elastic material are increased and the resistivity of the transfer fixing belt 2A is changed.

Specifically, the transfer fixing belt 2A has a volume resistance of $10^{13}$ Ω·cm or more when pressure of 0.05 kg/cm$^2$ is applied to the surface thereof When pressure is applied, for intermediate transfer, to between each of the photoconductors 3Y, 3M, 3C, 3K (toner image bearing members) and the transfer fixing belt 2A, the transfer fixing belt 2A has a volume resistance of $10^6$ Ω·cm or more to less than $10^{12}$ Ω·cm. When pressure is applied, for transfer fixing, to between the transfer fixing belt 2A and the pressurizing roller 14, the transfer fixing belt 2A has a volume resistance of less than $10^6$ Ω·cm. The transfer fixing belt 2A has a surface resistivity (volume resistance) of $10^{12}$ Ω·cm or more when pressure of 0.05 kg/cm$^2$ is applied to the surface thereof. The transfer fixing belt 2A has a surface resistivity of $10^{10}$ Ω·cm or more to less than $10^{12}$ Ω·cm when pressure is applied for intermediate transfer to the surface thereof The transfer fixing belt 2A has a surface resistivity of less than $10^9$ Ω·cm when pressure is applied to the surface thereof for transfer fixing. Thus, the resistance of the transfer fixing belt 2A is decreased in the fixing nip, thereby removing charge from the transfer fixing member charged by electrostatic transfer.

The pressure applied for intermediate transfer is 0.2 $kg/cm^2$ to 2.0 $kg/cm^2$. When it is less than 0.2 $kg/cm^2$, the transfer ratio may be decreased. When it is more than 2.0 $kg/cm^2$, absence of dot may easily occur. The pressure applied for transfer fixing is 3.0 $kg/cm^2$ to 20 $kg/cm^2$. When it is less than 3.0 $kg/cm^2$, a toner and a recording medium are not sufficiently contacted, and the transfer fixing property may be degraded. When it is more than 20 $kg/cm^2$, the durability of a transfer fixing member may be degraded.

The volume resistance is measured by applying a voltage of 100V to the transfer fixing member for 10 seconds by means of a measurement method according to JIS K 6911. The surface resistivity is measured by a resistance meter, HIGHRESTER IP by Mitsubishi Chemical Corporation. Alternatively, the surface resistivity can be measured with a surface resistance measurement method according to JIS K 6911.

The base 2*a* constituting the transfer fixing belt 2A has a shape suitable for forming an image. In this embodiment, it has an endless-belt shape. The base 2*a* needs to have heat resistance and mechanical strength, and metals such as stainless steel, nickel and aluminum, and resins such as polyimide and polyimideamide can be used for the base 2*a*. When the resin is used, a conductive material is added to control resistivity. Examples of the conductive materials include conductive powders and conductive fibers.

The surface elastic layer 2*c* is composed of an elastic material in which a conductive material is dispersed, and has a storage elastic modulus E' of $1.0\times10^5$ Pa to $2.5\times10^7$ Pa and a loss elastic modulus E" of $5.0\times10^3$ Pa to $1.0\times10^5$ Pa in a temperature range of 60° C. to 200° C. By setting the elastic modulus in the above range, the outermost surface layer of the transfer fixing belt 2A follows irregularities of a paper as a recording medium and exerts excellent transfer fixing property. When the elastic modulus is out of the above range, the durability of the transfer fixing belt 2A may seriously degrade and it does not sufficiently follow irregularities of a paper. The outermost surface layer of the transfer fixing belt 2A cannot completely follow irregularities of a paper, but, a toner on the transfer fixing belt 2A is heated and exists as agglomerates of toner particles, thereby obtaining excellent transfer property even though the outermost surface layer of the transfer fixing belt 2A less follows irregularities of a paper, compared to a toner image formed from unheated individual toner. When the storage elastic modulus E' is more than $2.5\times10^7$ Pa, the electric resistivity is hard to be changed by applying pressure. When it is less than $1.0\times10^5$ Pa, the durability of the transfer fixing belt 2A is decreased.

By dispersing the conductive material in the surface elastic layer 2*c*, offset caused by the conductive material easily occurs. Thus, the amount of the conductive material is necessary to be decreased. However, when the amount of the conductive material is inadequate, appropriate resistance cannot be obtained, and a nonuniform image occurs in intermediate transfer by means of electrostatic transfer. Therefore, in the present invention, electric resistivity can be changed under pressurization by using a predetermined elastic material as a matrix material of the surface elastic layer.

The elastic material used for the surface elastic layer 2*c* is preferably a fluorosilicone rubber or fluorocarbon siloxane rubber.

The conductive material is not particularly limited and may be selected accordingly. Examples thereof include metal powders of carbon black, graphite, aluminum, nickel and the like; and conductive metal oxides such as tin oxide, titanium oxide, antimony oxide, indium oxides, potassium titanate, antimony oxide-tin oxide (ATO) and indium oxide-tin oxide (ITO). For the conductive metal oxide, the one coated with insulating fine particles such as barium sulfate, magnesium silicate and calcium carbonate may also be used. It is understood that the conductive materials are not limited thereto. The shape of the conductive material is preferably one suitable for a switching material, for example in a granular shape.

The surface elastic layer 2*c* preferably has a thickness of 200 μm to 1,500 μm. When it is less than 200 μm, the followability to paper surface is low under pressurization. When it is more than 1,500 μm, the heat capacity of the transfer fixing member is increased, resulting in a disadvantage to high speed temperature rising, and loss of durability Moreover, a wax component in an oilless toner preferably has a receding contact angle with the surface elastic layer 2*c* of 55° or less at a transfer fixing temperature. The receding contact angle means oil wettability to a surface elastic layer. There is a method in which the releasing property of the surface elastic layer 2*c* itself is expected by using a wax having a receding contact angle of more than 55° and advancing contact angle of 55° or more to the surface elastic layer 2*c*. Such wax is used to exert excellent releasing property of the surface elastic layer 2*c*.

Next, a second embodiment of the image forming apparatus of the present invention will be explained.

Figure 4:
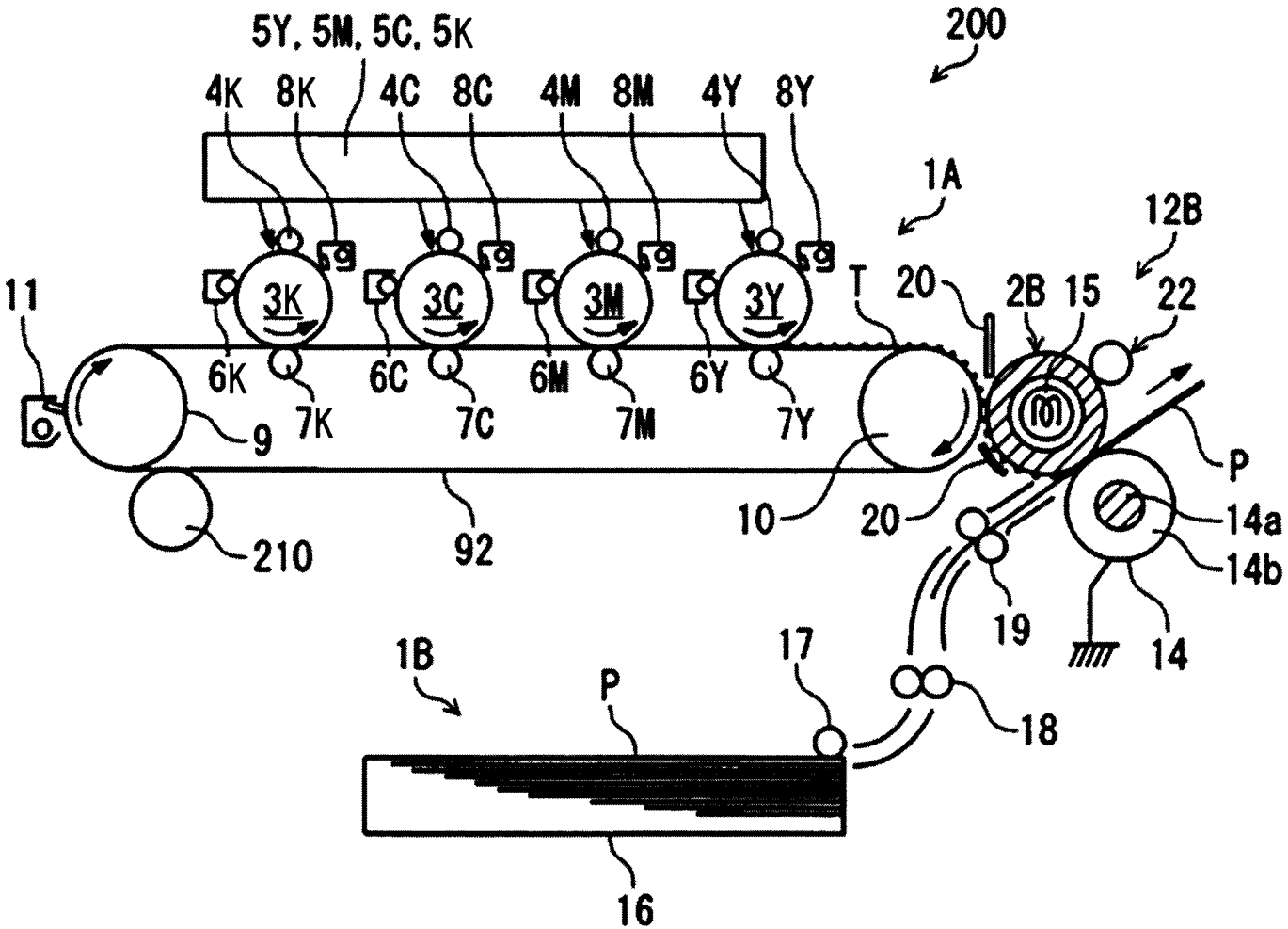
FIG. 4 is a schematic view showing an example of a configuration in the second embodiment of an image forming apparatus of the present invention.

A configuration of a tandem color copier which is an image forming apparatus of the present invention is shown in FIG. 4.

A color copier 200 contains an image forming unit 1A located in the center of the apparatus, a paper feed unit 1B located below the image forming unit 1A and an image reading unit (not shown) located above the image forming unit 1A.

In the image forming unit 1A, an intermediate transfer belt 92, which is the same one as used in the transfer device in FIG. 1, is arranged as an intermediate transfer medium having a transfer surface extended in a horizontal direction and a configuration for forming images of colors having complementary relations with colors for color separation is provided above the upper surface of the intermediate transfer belt 92. In other words, photoconductors 3Y, 3M, 3C and 3K, as image bearing members which can bear images using toners of colors having complementary relations (yellow, magenta, cyan and black) are arranged in parallel along a transfer surface of the intermediate transfer belt 92. The order of each color is not limited thereto.

Photoconductors 3Y, 3M, 3C and 3K are formed in drum shapes and configured to be rotatable in the same direction (in counterclockwise direction), and charging devices 4Y, 4M, 4C and 4K which perform image forming process during rotation, writing devices 5Y, 5M, 5C and 5K as optical writing units, developing devices 6Y, 6M, 6C and 6K, primary transfer devices 7Y, 7M, 7C and 7K, and cleaning devices 8Y, 8M, 8C and 8K, are respectively arranged around each of the photoconductors. The alphabets attached to respective reference numerals correspond to respective toner colors similar to the photoconductors 3Y, 3M, 3C and 3K. Each developing device 6Y, 6M, 6C and 6K contains a toner of each color.

The intermediate transfer belt 92 is stretched around a driving roller 9 and driven roller 10, and configured to be movable in the same direction as the driving roller 9 and driven roller 10 while facing the photoconductors 3Y, 3M, 3C and 3K. A cleaning device 11 configured to clean a surface of the intermediate transfer belt 92 is disposed facing the driving roller 9 via the intermediate transfer belt 92.

A transfer fixing device 12B is disposed near the driven roller 10. The transfer fixing device 12B contains a transfer fixing roller 2B as a transfer fixing member to which an unfixed toner image as an image on the intermediate transfer belt 92 is transferred, and a pressurizing roller 14 as a pressurizing member or facing member, which forms a nip N (hereinafter referred to as a nip or fixing nip) with the transfer fixing roller 2B. The transfer fixing roller 2B has the same configuration as the transfer fixing belt of the first embodiment (FIG. 3) although their shapes differ. That is, the base 2*a* formed of a metal such as aluminum is shaped in a pipe, and the surface elastic layer 2*c* as a release layer is formed over a surface of the base 2*a* via a primer layer 2*b*. Moreover, a halogen heater 15 is disposed inside the transfer fixing roller 2B as a heating unit configured to heat the toner image on the transfer fixing roller 2B.

A heat-insulating plate 20 as a heat shielding member or heat transfer suppressing member which suppresses heat radiation (heat transfer) from the transfer fixing roller 2B to the intermediate transfer belt 92 is disposed between the intermediate transfer belt 92 and the transfer fixing roller 2B. The heat-insulating plate 20 is formed to have an opening in order to suppress the heat radiation to the intermediate transfer belt 92 as much as possible without inhibiting the secondary transfer from the intermediate transfer belt 92 to the transfer fixing roller 2B, and may be disposed in either a fixing device main body or an image forming apparatus main body (not shown). As a heat transfer suppressing member, a plate-like one having metallic luster with low emittance is preferably used. Particularly, two metal sheets are disposed so as to sandwich a microscopic space or heat-insulating material therebetween, thereby obtaining excellent effect. Moreover, the heat transfer suppressing member is maintained at low temperature so as to suppress heat transfer when a thin plate containing a micro-heat pipe structure used for cooling down CPU of a laptop personal computer is used.

In this embodiment, a cooling roller 210, which removes heat from the intermediate transfer belt 92, is disposed between a transfer position of the intermediate transfer belt 92 facing the transfer fixing roller 2B (a portion facing the transfer fixing roller 2B) and a transfer position facing the photoconductor 3K in the uppermost stream. The cooling roller 210 is formed of a material having high heat conductivity, and it rotates in contact with the intermediate transfer belt 92. In this embodiment, the heat-insulating plate 20 and the cooling roller 210 are arranged together, however, either one of them may be arranged. According to this embodiment, a temperature of the intermediate transfer medium can be lowered, and adverse affect of heat in the intermediate transfer member can be suppressed. Moreover, the degree of design freedom of the transfer fixing member may be increased.

The paper feed unit 1B contains a paper feed tray 16 which contains a recording paper P as a recording medium, a paper feed roller 17 which feeds a paper by separating the recording papers P one by one from the uppermost paper in the paper feed tray 16, a pair of conveying rollers 18 which convey the fed recording paper P and a pair of resist roller pairs 19 by which the recording paper P is sent to the nip N at the timing in which a leading end of an image on the transfer fixing roller 13 and a predetermined position in a conveying direction agrees with each other after the recording paper P is stopped temporarily to correct a diagonal misalignment.

In the image forming apparatus 200 of the present invention, a surface of the photoconductor 3Y is uniformly charged by the charging device 4Y and a latent electrostatic image is formed on the photoconductor 3Y according to the image information provided from the image reading unit. The latent electrostatic image is then made visible as a toner image by the developing device 6Y which contains a yellow toner. The toner image is then primarily transferred onto the intermediate transfer belt 92 by the primary transfer device 7Y, to which a predetermined bias is applied. The developing devices 6Y, 6M, 6C and 6K are not limited to either one-component developing device or two-component developing device. The same image forming process as described above is performed on other photoconductors 3M, 3C and 3K, in which only colors of toners differ and toner images of respective colors are sequentially transferred onto the intermediate transfer belt 92 so as to be superimposed. The residual toners on the photoconductors 3Y, 3M, 3C and 3K after images are transferred are removed by the cleaning devices 8Y, 8M, 8C and 8K. Furthermore, electric potentials of the photoconductors 3Y, 3M, 3C and 3K are initialized by a charge removing lamp (not shown) to be ready for the next image forming step.

The toner image T (hereinafter referred to as a toner) primarily transferred onto the image transfer belt 92 from the photoconductors 3Y, 3M, 3C, 3K is secondarily transferred onto the transfer fixing roller 2B by a electrostatic bias (including superposed bias such as AC, pulse, etc.) applied to the driven roller 10 by a bias applying unit (not shown).

The toner image T, which is transferred from the intermediate transfer belt 92 to the transfer fixing roller 2B, is independently heated on the transfer fixing roller 2B until it is fixed to the recording paper P at the fixing nip N. Only the toner image T can be sufficiently heated in advance, thereby lowering a heating temperature, compared to that of the conventional system in which the toner image T and the recording paper P are heated simultaneously. Moreover, the function of a wax as a releasing agent can be sufficiently obtained, because it takes a long time to expose the wax on the toner surface. Finally, the toner image T on the transfer fixing roller 2B is simultaneously transferred and fixed on the recording paper P at the nip N.

At this time, the transfer fixing roller 2B is charged, the pressurizing roller 14 is made as a conductive roller and grounded to have a ground potential, and then contacted with the transfer fixing roller 2B to remove charge of the transfer fixing roller 2B. Alternatively, a charge removing brush is contacted with the transfer fixing roller 2B so as to remove charge thereof.

Figure 7:
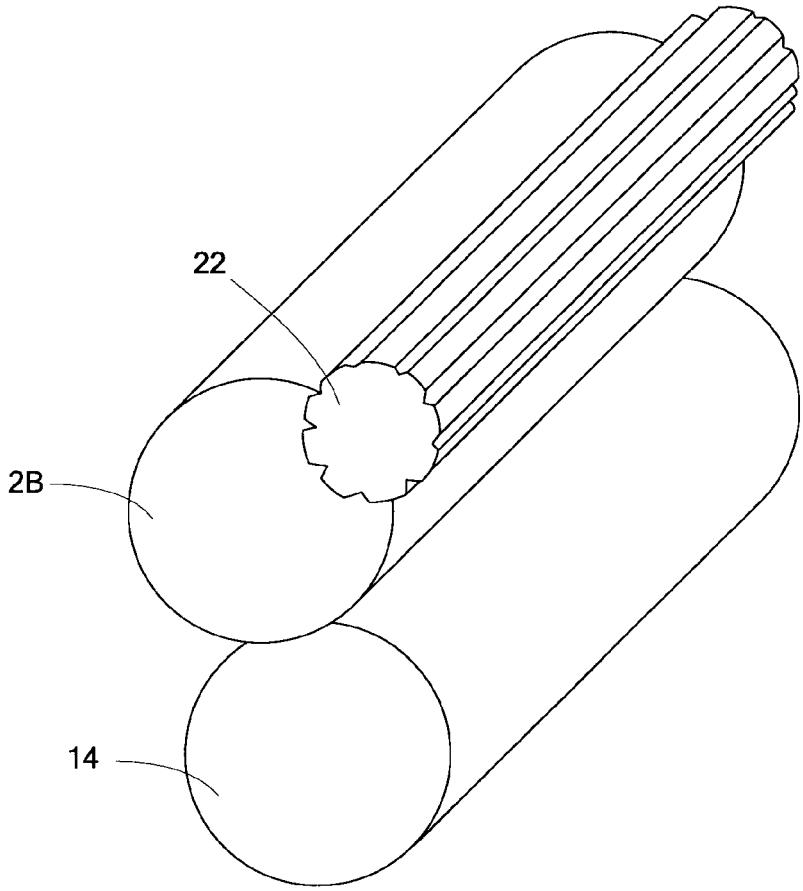
FIG. 7 is an explanatory view showing an example of the concave portions of a cleaning roller.

Untransferred toners left on the transfer fixing roller 2B at the nip N or unfixed toner left on the transfer fixing roller 2B caused by paper jam are removed by a cleaning roller 22. In this case, the toner image on the transfer fixing roller is in a condition of being heated and melted. A plurality of concave portions are formed on the surface of the cleaning roller 22. The longitudinal length of the plurality of concave portions is longer than the longitudinal length of the transfer fixing roller 2B (FIG. 7). A cooling member (not shown) may be disposed subsequent to the cleaning roller 22 on the transfer fixing roller 2B for preventing heat transfer to the intermediate transfer medium, as necessary.

The transfer fixing roller 2B contains a pipe-shaped base 2*a*, a primer layer 2*b* and a surface elastic layer 2*c* composed of an elastic material, in which a conductive material is dispersed, wherein the surface elastic layer 2*c* is formed over the pipe-shaped base 2*a* via the primer layer 2*b*. When a surface pressure corresponding to a pressure applied to between the intermediate transfer belt 92 (a toner image bearing member) and the transfer fixing roller 2B is 0.2 kg/cm$^2$ to 2.0 kg/cm$^2$, the transfer fixing roller 2B has a volume resistance of $10^6$ Ω·cm or more to less than $10^{12}$ Ω·cm. When a surface pressure corresponding to a pressure applied to between the transfer fixing roller 2B and the pressurizing roller 14 is 3.0 kg/cm$^2$ to 20 kg/cm$^2$, the transfer fixing roller 2B has a volume resistance of less than $10^6$ Ω·cm.

The surface elastic layer preferably has a storage elastic modulus E' of $5.0\times10^5$ Pa to $5.0\times10^6$ Pa and a loss elastic modulus E" of $5.0\times10^3$ Pa to $1.5\times10^5$ Pa in a temperature range of 60° C. to 200° C.

The elastic material used for the surface elastic layer is preferably a fluorosilicone rubber or fluorocarbon siloxane rubber.

The conductive material used for the surface elastic layer is not particularly limited and may be selected accordingly. Examples thereof include metal powders of carbon black, graphite, aluminum, nickel and the like; and conductive metal oxides such as tin oxide, titanium oxide, antimony oxide, indium oxides, potassium titanate, antimony oxide-tin oxide (ATO) and indium oxide-tin oxide (ITO). For the conductive metal oxide, the one coated with insulating fine particles such as barium sulfate, magnesium silicate and calcium carbonate may also be used. It is understood that the conductive materials are not limited thereto. The shape of the conductive material is preferably one suitable for a switching material, for example in a granular shape.

The surface elastic layer 2*c* preferably has a thickness of 200 μm to 1,500 μm. When it is less than 200 μm, the followability to paper surface is low under pressurization. When it is more than 1,500 μm, the heat capacity of the transfer fixing member is increased, resulting in a disadvantage to high speed temperature rising, and loss of durability Moreover, a wax component in an oilless toner preferably has a receding contact angle with the surface elastic layer 2*c* of 55° or less at a transfer fixing temperature.

As described above, 1.5 times of heat quantity has been provided in conventional color image forming apparatuses as compared to black and white image forming apparatuses for the purpose of obtaining sufficient glossiness in consideration of temperature decrease caused by a recording paper. Thus, the recording paper is heated more than necessary, and adhesion property of the toner and the recording paper is also increased beyond necessity. On the other hand, in this embodiment, in order to obtain sufficient glossiness, the temperature can be adjusted independently without consideration of the recording paper P, thus, it is possible to lower the temperature (fixing temperature) of the transfer fixing roller 2B. In addition, because the recording paper P is heated only at the fixing nip N, it is not excessively heated and adhesion property of the toner image T and the recording paper is not increased needlessly.

Next, a third embodiment of the image forming apparatus of the present invention will be explained.

Figure 5:
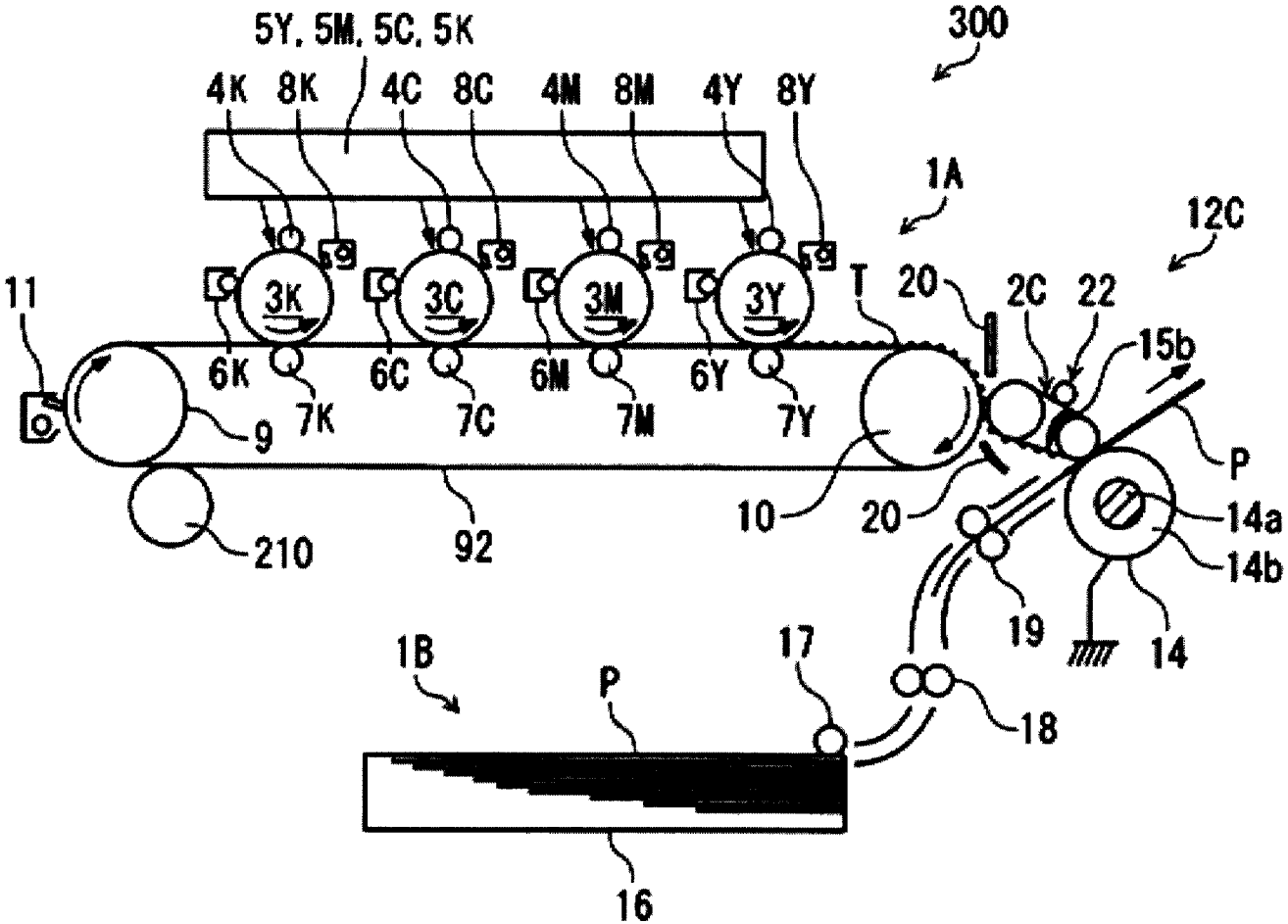
FIG. 5 is a schematic view showing an example of a configuration in the third embodiment of an image forming apparatus of the present invention.

A configuration of a tandem color copier which is an image forming apparatus of the present invention is shown in FIG. 5.

A color copier 300 contains an image forming unit 1A located in the center of the apparatus, a paper feed unit 1B located below the image forming unit 1A and an image reading unit (not shown) located above the image forming unit 1A.

In the image forming unit 1A, an intermediate transfer belt 92, photoconductors 3Y, 3M, 3C and 3K, charging devices 4Y, 4M, 4C and 4K, writing devices 5Y, 5M, 5C and 5K, developing devices 6Y, 6M, 6C and 6K, primary transfer devices 7Y, 7M, 7C and 7K, cleaning devices 8Y, 8M, 8C and 8K, a driving roller 9, a driven roller 10, a cleaning device 11 and a cooling roller 210 are the same as those illustrated in the second embodiment.

A transfer fixing device 12C is disposed near the driven roller 10. The transfer fixing device 12C contains a transfer fixing belt 2C as a transfer fixing member to which an unfixed toner image as an image on the intermediate transfer belt 92 is transferred, and a pressurizing roller 14 which forms a nip N with the transfer fixing belt 2C. The transfer fixing belt 2C has the same configuration as the transfer fixing belt of the first embodiment (FIG. 3). That is, the transfer fixing belt 2C contains an endless-belt shaped base 2*a*, a primer layer 2*b* and a surface elastic layer 2*c* as a release layer, wherein the surface elastic layer 2*c* is formed over a surface of the endless-belt shaped base 2*a* via the primer layer 2*b*, and is stretched around two rollers. Moreover, an IH heater 15*b* as a heating unit configured to heat one of the rollers so as to heat the toner image on the transfer fixing belt 2C is disposed between the two rollers.

A heat-insulating plate 20 which suppresses heat radiation (heat transfer) from the transfer fixing belt 2C to the intermediate transfer belt 92 is disposed between the intermediate transfer belt 92 and the transfer fixing belt 2C. The heat-insulating plate 20 is formed to have an opening in order to suppress the heat radiation to the intermediate transfer belt 92 as much as possible without inhibiting the secondary transfer from the intermediate transfer belt 92 to the transfer fixing belt 2C, and may be disposed in either a fixing device main body or an image forming apparatus main body.

In addition, a paper feed unit 1B has the same configuration as that of the second embodiment.

As described above, in the image forming apparatus 200 of the present invention the roller shaped transfer fixing roller 2B and the halogen heater 15 are respectively replaced with the endless belt shaped transfer fixing belt 2C and the IH heater 15*b* in the image forming apparatus 300 of the present invention.

Therefore, in the image forming apparatus 300 of the present invention an image is formed in the same manner as in the second embodiment until the toner image T is primarily transferred onto the image transfer belt 92. And then, the toner image T on the image transfer belt 92 is secondarily transferred onto the transfer fixing belt 2C by an electrostatic bias applied to the driven roller 10 by a bias applying unit (not shown).

The toner image T, which is transferred from the intermediate transfer belt 92 to the transfer fixing belt 2C, is independently heated on the transfer fixing belt 2C by the IH heater 15*b* until it is fixed to the recording paper P at the fixing nip N. Only the toner image T can be sufficiently heated in advance, thereby lowering a heating temperature, compared to that of the conventional system in which the toner image T and the recording paper P are heated simultaneously. Moreover, the function of a wax as a releasing agent can be sufficiently obtained, because it takes a long time to expose the wax on the toner surface. Finally, the toner image T on the transfer fixing belt 2C is simultaneously transferred and fixed on the recording paper P at the nip N.

At this time, the transfer fixing belt 2C is charged, the pressurizing roller 14 is made as a conductive roller and grounded to have a ground potential, and then contacted with the transfer fixing belt 2C to remove charge of the transfer fixing belt 2C. Alternatively, a charge removing brush is contacted with the transfer fixing belt 2C so as to remove charge thereof.

Untransferred toners left on the transfer fixing belt 2C at the nip N or unfixed toner left on the transfer fixing belt 2C caused by paper jam are removed by a cleaning roller 22.

A transfer fixing belt 2C contains an endless-belt shaped base 2*a*, a primer layer 2*b* and a surface elastic layer 2*c* composed of an elastic material, in which a conductive material is dispersed, wherein the surface elastic layer 2*c* is formed over the endless-belt shaped base 2*a* via the primer layer 2*b*.

When a surface pressure corresponding to a pressure applied to between the intermediate transfer belt 92 (a toner image bearing member) and the transfer fixing belt 2C is 0.2 kg/cm$^2$ to 2.0 kg/cm$^2$, the transfer fixing belt 2C has a volume resistance of $10^6$ Ω·cm or more to less than $10^{12}$ Ω·cm. When a surface pressure corresponding to a pressure applied to between the transfer fixing belt 2C and the pressurizing roller 14 is 3.0 kg/cm$^2$ to 20 kg/cm$^2$, the transfer fixing belt 2C has a volume resistance of less than $10^6$ Ω·cm.

The surface elastic layer preferably has a storage elastic modulus E' of $5.0\times10^5$ Pa to $5.0\times10^6$ Pa and a loss elastic modulus E" of $5.0\times10^3$ Pa to $1.5\times10^5$ Pa in a temperature range of 60° C. to 200° C.

The elastic material used for the surface elastic layer is preferably a fluorosilicone rubber or fluorocarbon siloxane rubber.

The conductive material used for the surface elastic layer is not particularly limited and may be selected accordingly. Examples thereof include metal powders of carbon black, graphite, aluminum, nickel and the like; and conductive metal oxides such as tin oxide, titanium oxide, antimony oxide, indium oxides, potassium titanate, antimony oxide-tin oxide (ATO) and indium oxide-tin oxide (ITO). For the conductive metal oxide, the one coated with insulating fine particles such as barium sulfate, magnesium silicate and calcium carbonate may also be used. It is understood that the conductive materials are not limited thereto. The shape of the conductive material is preferably one suitable for a switching material, for example in a granular shape.

The surface elastic layer 2*c* preferably has a thickness of 200 μm to 1,500 μm. When it is less than 200 μm, the followability to paper surface is low under pressurization. When it is more than 1,500 μm, the heat capacity of the transfer fixing member is increased, resulting in a disadvantage to high speed temperature rising, and loss of durability Moreover, a wax component in an oilless toner preferably has a receding contact angle with the surface elastic layer 2*c* of 55° or less at a transfer fixing temperature.

As described above, 1.5 times of heat quantity has been provided in conventional color image forming apparatuses as compared to black and white image forming apparatuses for the purpose of obtaining sufficient glossiness in consideration of temperature decrease caused by a recording paper. Thus, the recording paper is heated more than necessary, and adhesion property of the toner and the recording paper is also increased beyond necessity. On the other hand, in this embodiment, in order to obtain sufficient glossiness, the temperature can be adjusted independently without consideration of the recording paper P, thus, it is possible to lower the temperature (fixing temperature) of the transfer fixing belt 2C. In addition, because the recording paper P is heated only at the fixing nip N, it is not excessively heated and adhesion property of the toner image T and the recording paper is not increased needlessly.

According to the above-described configuration, the image forming apparatus of the present invention can achieve high-speed fixing and energy conservation in any embodiment.

Hereinafter, a toner used in the present invention will be explained.

The toner used in the image forming apparatus of the present invention contains resins, such as known binder resins and the like.

Examples thereof include polymers of styrenes or substituted styrenes such as polyester, polystyrene, poly-p-chlorostyrene, polyvinyl toluene, and the like; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleic acid ester copolymer.

Additionally, the following resins may be mixed for use: polymethyl methacrylate, polybutyl methacrylate, polyvinyl chloride, polyvinyl acetate, polyethylene, polypropylene, polyurethane, polyamide, epoxy resins, polyvinyl butyral, polyacrylic resins, rosins, modified rosins, terpene resins, phenol resins, aliphatic or alicyclic hydrocarbon resins, aromatic petroleum resins, chlorinated paraffin and paraffin wax.

Of these, polyester resins are preferable for obtaining sufficient fixing property. Since a polyester resin basically has an excellent fixing property at low temperature, it exhibits excellent fixing property at low temperature when used for heating and fixing device of film-heating system and it also excels in glossiness.

A polyester resin is obtained by condensation polymerization of alcohol and carboxylic acid. Examples of alcohols include diols such as polyethylene glycol, diethylene glycol, triethylene glycol, 1,2-propylene glycol, 1,3-propylene glycol, 1,4-butanediol, neopentyl glycol and 1,4-butenediol, 1,4-bis (hydroxymethyl) cyclohexane, bisphenol A, hydrogen-added bisphenol A, etherificated bisphenols such as polyoxyethylene bisphenol A and polyoxypropylene bisphenol A, bivalent alcohols obtained by substituting the above compounds with a saturated or unsaturated hydrocarbon groups having 3 to 22 carbon atoms and other bivalent alcohols.

Furthermore, examples of carboxylic acids used for obtaining polyester resins include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, bivalent organic acid monomers obtained by substituting thereof with a saturated or unsaturated hydrocarbon group having 3 to 22 carbon atoms, acid anhydride is thereof, dimer of lower alkylester and linolenic acid and other bivalent organic acid monomers.

In order to obtain polyester resins used as binder resins, it is also preferable to use not only polymers of bifunctional monomers as described above, but also polymers containing component of polyfunctional monomers of trifunctional or more. Examples of polyvalent alcohol monomers of trivalent or more which are the polyfunctional monomers of trifunctional or more include sorbitol, 1,2,3,6-hexanetetrol, 1,4-sorbitan, pentaerythritol, dipentaerythritol, tripentaerythritol, sucrose, 1,2,4-butantriol, 1,2,5-pentantriol, glycerol, 2-methylpropanetriol, 2-methyl-1,2,4-butantriol, trimethyrolethane, trimethyrolpropane and 1,3,5-trihydroxymethylbenzene.

Examples of polyvalent carboxylic acid monomers of trivalent or more include 1,2,4-benzenetricarboxylic acid, 1,2,5-benzentricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl) methane, 1,2,7,8-octanetetracarboxylic acid, enpol trimeric acid and anhydrides thereof.

Moreover, modified polyesters may be used for the polyester resins contained as the toner binders. The modified polyester (MPE) is a polyester resin having a binding group other than functional groups and ester bond which are contained in a monomer unit of above-mentioned acids and alcohols, or a polyester resin having resin components having a different structure, which are bonded by covalent bonding or ion binding. Examples of modified polyesters include a polyester of which terminals are reacted with bonds other than ester bonds and in particular, a polyester in which a functional group such as an isocyanate group reacting with an acid group and hydroxyl group is introduced into polyester terminals and further reacts with an active hydrogen compound, thereby modifying or elongating the terminal. Furthermore, a compound in which polyester terminals are bonded with each other (such as a urea-modified polyester, urethane-modified polyester, and the like) are also included, if the compound contains plurality of active hydrogen groups. In addition, also included is a modified polyester in which a reactive group such as a double bond is introduced in a main chain and radical polymerization occurs therefrom so as to introduce a grafted component of carbon-carbon bond in the side chains or crosslink double bonds with each other (such as a styrene-modified or acryl-modified polyester, and the like). And a modified polyester in which resin components having a different structure are copolymerized or reacted with a terminal carboxyl group or hydroxyl group in a main chain of the polyester, for example, a modified polyester, in which a silicone resin of which terminals are modified with a carboxyl group, hydroxyl group, epoxy group or mercapto group is copolymerized, is also included (for example, a silicon-modified polyester and the like).

According to the present invention, the toner preferably has a melting temperature of 80° C. to 140° C. for achieving high speed and energy conservation. The melting temperature of less than 80° C. adversely affects the heat-resistant storage property of an image, and the melting temperature of more than 140° C. is not preferable in terms of heat effect on a recording medium and energy conservation. Moreover, the toner generally has a glass transition temperature (Tg) of 50° C. to 80° C., and preferably 55° C. to 65° C. The glass transition temperature of less than 50° C. may adversely affect heat resistance of a toner, and the toner fixes to a developing unit due to temperature rise in an apparatus. The glass transition temperature of more than 80° C. may bring to insufficient fixing property at low temperature.

Moreover, a wax is preferably contained with the toner binder and a colorant. As mentioned above, it is important that the wax component has a receding contact angle with the surface of the transfer fixing member of 55° or less at a transfer fixing temperature. When the receding contact angle is 55° or less, a wax has high wettability to the transfer fixing member, and the releasing effect of the wax is sufficiently exerted. In transfer fixing a toner is heated for a long time, thus, it takes a long time to expose the wax on the interface between the toner binder and the transfer fixing member. When the receding contact angle is 55° or less, an area in which the toner binder directly contacts with the transfer fixing member becomes extremely small. When the receding contact angle is more than 55°, the wax component is repelled on the surface of the transfer fixing member, and an area in which the toner binder directly contacts with the transfer fixing member becomes large. As a result, an adhesion force of an image to the transfer fixing member is increased, thereby adversely affecting the releasing property.

The known waxes can be used as long as the above conditions are satisfied. Examples thereof include vegetable waxes such as rice wax, japan wax, and the like, animal waxes such as yellow beeswax, mineral waxes such as montan wax, petroleum waxes such as paraffin wax, and other polyolefin waxes (polyethylene wax, polypropylene wax, etc.); and long-chain hydrocarbon (paraffin wax, Sasol Wax, etc.) acid amide and synthesized ester wax.

The wax generally has a melting point (Tw) of 40° C. to 160° C. and it is preferably Tg of the toner binder resin (Tgt) or more and the melting temperature of the toner binder (Tmt) or less. The wax having a melting point of less than Tgt may adversely affect heat-resistant storage property, and the wax having a melting point of more than Tmt is not effective on cold offset at low temperature in fixing. Furthermore, the wax preferably has a melt viscosity of 5 cps to 1,000 cps, and more preferably 10 cps to 100 cps as measured at a temperature of 20° C. higher than the melting point. The wax having a melt viscosity of more than 1,000 cps less improves hot offset resistance and fixing property at low temperature. The amount of the wax in the toner is generally 5% by mass to 40% by mass, and preferably 5% by mass to 30% by mass. When the amount is more than 30% by mass, the wax tends to be exposed on the toner surface and may cause a problem of flowability of the toner.

In the toner used in the present invention fine inorganic particles can be preferably added as an external additive for enhancing flowability, developing property and transfer property. The fine inorganic particles preferably have a primary particle diameter of 5 nm to 200 nm, and more preferably 10 nm to 150 nm. The toner preferably has a BET specific surface area of 20 $m^2/g$ to 500 $m^2/g$. The amount of the fine inorganic particles is preferably 0.01% by mass to 5% by mass and more preferably 0.01% by mass to 2.0% by mass of the toner. Specific examples of the fine inorganic particles include silica, alumina, titanium oxide, barium titanate, magnesium titanate, calcium titanate, strontium titanate, zinc oxide, tin oxide, silicate sand, clay, mica, silicic pyroclastic rock, diatomaceous earth, chromic oxide, cerium oxide, colcothar, antimony trioxide, magnesium oxide, zirconium oxide, barium sulfate, barium carbonate, calcium carbonate, silicon carbide and silicon nitride. And others also included are high molecule particles such as polystyrene, methacrylic acid ester and acrylic acid ester copolymers obtained by soap-free emulsion polymerization, suspension polymerization or dispersion polymerization, silicone, benzoguanamine, and nylon obtained by polycondensation and polymer particles derived from heat-curable resin.

The flowability improvers can prevent from degrading the flowability or the charging ability even under a condition of high moisture by treating the surface of the toner to increase its hydrophobicity. Examples of surface-treating agents include silane coupling agents, silylation agents, silane coupling agents having an alkyl fluoride group, organic titanate coupling agents, aluminum coupling agents, silicon oil and modified silicon oil. Examples of cleaning ability improvers for removing a residual developer on a photoconductor or a primary transfer medium after transferring include aliphatic acid metal salts such as zinc stearate, calcium stearate and stearic acid and fine polymer particles manufactured by soap-free emulsion polymerization such as fine polymethylmethacrylate particles or fine polystyrene particles. The fine polymer particles preferably have relatively narrow particle size distribution and a volume average particle diameter of 0.01 μm to 1 μm.

Other components are not particularly limited and may be selected accordingly. Examples thereof include colorants, releasing agents, charge controlling agents, magnetic materials and metal soaps.

The colorants are not particularly limited and may be selected from known dyes and pigments accordingly. Examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthrazane yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone.

These may be used alone or in combination.

The amount of the colorant in the toner is not particularly limited and may be adjusted accordingly. It is preferably 1% by mass to 15% by mass, and more preferably 3% by mass to 10% by mass.

When the amount is less than 1% by mass, coloring power of the toner is decreased. When the amount is more than 15% by mass, the pigments may be insufficiently dispersed in the toner, resulting in poor coloring power or electric properties of the toner.

The colorant may be used as a master batch being combined with a resin. Such resin is not particularly limited and may be selected from known resins accordingly. Examples thereof include polymers of styrenes or substituted styrenes, styrene copolymers, polymethyl methacrylate, polybuthyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid resins, rosins, modified rosins, terpene resins, aliphatic or alicyclic hydrocarbon resins, aromatic petroleum resins, chlorinated paraffin and paraffin wax. These may be used alone or in combination.

Examples of polymers of styrene or substituted styrenes include polyester resins, polystyrene, poly-p-chlorostyrene and polyvinyl toluene. Examples of styrene copolymers include a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleic ester copolymer.

The master batch can be obtained by mixing and kneading a resin for master batch and the colorant with high shear force. To improve interaction between the colorant and resin, it is preferable to add an organic solvent. In addition, the "flushing process" in which a wet cake containing colorant can be applied directly, is preferable because it is not necessary to dry. In the flushing process, a water-based paste containing colorant and water is mixed and kneaded with a resin and an organic solvent, so that the colorant moves towards the resin, and that water and the organic solvent are removed. The materials are preferably mixed and kneaded using a high-shear dispersing device such as a triple roll mill.

The charge controlling agent is not particularly limited, and may be selected from those known accordingly. Examples of charge controlling agents include nigrosine dyes, triphenylmethane dyes, chrome-containing metal complex dyes, molybdic acid chelate pigments, rhodamine dyes, alkoxy amine, quaternary ammonium salts such as a fluoride-modified quaternary ammonium salt, alkylamide, phosphorus or compounds thereof, tungsten or compounds thereof, fluoride activators, salicylic acid metallic salts and salicylic acid derivative metallic salts. These may be used alone or in combination.

The charge controlling agents may be selected from the commercially available products. Specific examples thereof include Bontron 03 of nigrosin dye, Bontron P-51 of a quaternary ammonium salt, Bontron S-34 of metal-containing azo dye, Bontron E-82 of an oxynaphthoic acid metal complex, Bontron E-84 of a salicylic acid metal complex and Bontron E-89 of a phenol condensate by Orient Chemical Industries, Ltd.; TP-302 and TP-415 of a quaternary ammonium salt molybdenum metal complex by Hodogaya Chemical Co. Ltd.; Copy Charge PSY VP2038 of a quaternary ammonium salt, Copy Blue PR of a triphenylmethane derivative and Copy Charge NEG VP2036 and Copy Charge NX VP434 of a quaternary ammonium salt by Hoechst Ltd.; LRA-901, and LR-147 of a boron metal complex by Japan Carlit Co., Ltd.; copper phthalocyanine, perylene, quinacridone, azo pigment, and other high-molecular mass compounds having a functional group such as sulfonic acid, carboxyl group and quaternary ammonium salt.

The amount of the charge controlling agent in the toner depends on the type of a binder resin, presence or absence of external additives, and the dispersion process selected and cannot be unambiguously defined. However, the amount of charge controlling agent is preferably 0.1 parts by mass to 10 parts by mass and more preferably 0.2 parts by mass to 5 parts by mass relative to 100 parts by mass of the binder resin, for example. When the amount is less than 0.1 parts by mass, charge may not be appropriately controlled. When the amount is more than 10 parts by mass, charge ability of the toner becomes excessively large, and the effect of charge controlling agent itself is decreased and electrostatic attraction force with a developing roller is increased, thereby leading to poor developer flowability or poor image density.

The toner of the present invention can be manufactured by means of known methods such as suspension polymerization, emulsion polymerization, melting suspension, and the like.

For example, the toner can be obtained by emulsifying and/or dispersing a solution and/or dispersion liquid of the toner material in an aqueous medium to prepare an emulsion and/or dispersion liquid and then granulating the toner.

Moreover, the toner can be manufactured by using a spray granulation method using a piezo element or vibration olifice.

The toner used in the present invention preferably has a volume average particle diameter of 3 μm to 10 μm for obtaining high quality images and reducing gaps between toner particles in the toner image on the transfer fixing member. Moreover, a ratio of the volume average particle diameter (Dv) to a number average particle diameter (Dp), (Dv/Dp) is preferably 1.05 to 1.25. The toner preferably has an average circularity of 0.90 to 1.00. By using such toner, high quality images having stable fixing property can be attained.

The toner is housed in a predetermined toner container, and preferably used for the image forming apparatus of the present invention. The toner is preferably used for image formation based on known electrophotographic methods such as a magnetic one-component developing method, non-magnetic one-component developing method and two-component developing method.

EXAMPLES

Hereinafter, Examples of the present invention will be described, which however shall not be construed as limiting the scope of the present invention. All percentages and parts are by mass unless indicated otherwise.

First, a transfer fixing belt which is a transfer fixing member of the present invention was produced and continuous printing ability in the image forming apparatus using the transfer fixing belt was evaluated.

(1) Preparation of Transfer Fixing Member (Table 1)

(a) Transfer Fixing Member A

A transfer fixing belt 2A as shown in FIG. 3 was prepared under the following conditions.

A belt, in which carbon black was dispersed in polyimide, having 90 μm-thick was used as a base 2*a*, and a surface elastic layer 2*c* having 500 μm-thick was formed by dispersing 15 parts of carbon black as a conductive material in a fluorocarbon siloxane rubber (SIFEL3400 by Shin-Etsu Chemical Co., Ltd.) as an elastic material, and then the surface elastic layer 2*c* was formed over the base 2*a* via a primer layer 2*b*.

(b) Transfer Fixing Member B

A transfer fixing member B was prepared in the same conditions as in the transfer fixing member A, except that the amount of the carbon black in the surface elastic layer 2*c* in the transfer fixing member A was changed to 10 parts.

(c) Transfer Fixing Member C

A transfer fixing member C was prepared in the same conditions as in the transfer fixing member A, except that the carbon black in the transfer fixing member A was not added in the surface elastic layer 2*c*.

(d) Transfer Fixing Member D

A transfer fixing member D was prepared in the same conditions as in the transfer fixing member A, except that the amount of the carbon black in the surface elastic layer 2*c* in the transfer fixing member A was changed to 25 parts.

(e) Transfer Fixing Member E

Figure 6:
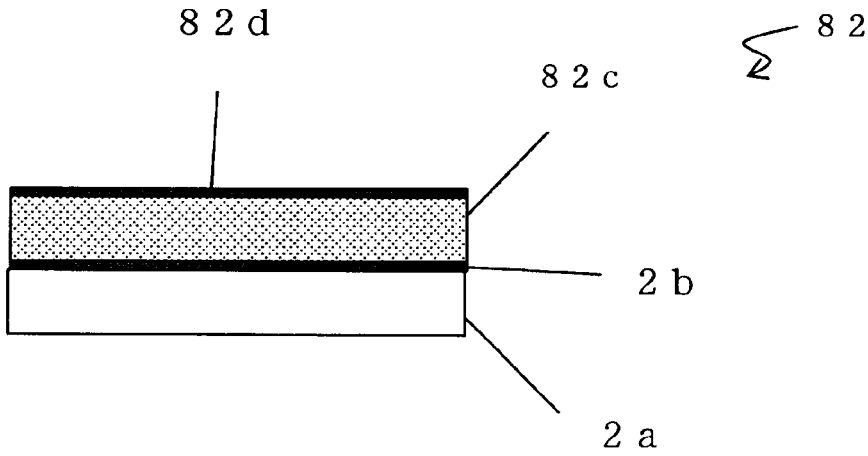
FIG. 6 is a cross-sectional view showing an example of a configuration of a transfer fixing member used in Comparative Example 3 of the present invention.

A transfer fixing belt 82 as shown in FIG. 6 was prepared under the following conditions.

A belt, in which carbon black was dispersed in polyimide, having 90 μm-thick was used as a base 2*a*, and a surface conductive layer 82*c* having 490 μm-thick was formed by dispersing a predetermined conductive material in a silicone rubber as an elastic material, and then the surface conductive layer 82*c* was formed over the base 2*a* via a primer layer 2*b*, and PFA release layer 82*d* having 15 μm-thick was further formed on the surface conductive layer 82*c*.

TABLE 1

| | | | Surface conductive layer | |
|---|---|---|---|---|
| | Configuration | Base | Elastic material for surface layer | Conductive material |
| Transfer fixing member A | FIG. 3 | polyimide (in which carbon black was dispersed) belt-shaped (90 μm-thick) | fluorocarbon siloxane rubber (SIFEL3400 by Shin-Etsu Chemical Co., Ltd.) | carbon black 15 parts |
| Transfer fixing member B | FIG. 3 | polyimide (in which carbon black was dispersed) belt-shaped (90 μm-thick) | fluorosilicone rubber | carbon black 10 parts |
| Transfer fixing member C | FIG. 3 | polyimide (in which carbon black was dispersed) belt-shaped (90 μm-thick) | fluorocarbon siloxane rubber (SIFEL3400 by Shin-Etsu Chemical Co., Ltd.) | None |
| Transfer fixing member D | FIG. 3 | polyimide (in which carbon black was dispersed) belt-shaped (90 μm-thick) | fluorocarbon siloxane rubber (SIFEL3400 by Shin-Etsu Chemical Co., Ltd.) | carbon black 25 parts |
| Transfer fixing member E | FIG. 6 | polyimide (in which carbon black was dispersed) belt-shaped (90 μm-thick) | silicone rubber (490 μm-thick) + outermost surface PFA release layer (15 μm-thick) | conductive material added in silicone rubber |

(2) Evaluation of Transfer Fixing Member

In the transfer fixing members A to E, the storage elastic modulus E' and loss elastic modulus E" of the respective materials of the surface conductive layers, and receding contact angles of a carnauba wax to each of the transfer fixing members at 150° C., in which the carnauba wax was the wax component contained in a toner used in Examples (oilless toner for IMAGIO NEO C600 by Ricoh Company, Ltd.), were measured. The storage elastic modulus E' and loss elastic modulus E" were measured on samples having a size of 5 mm-wide, 2 mm-thick and 20 mm-long by a sine-wave measurement under the conditions of a tensile mode, 1 Hz and an amplitude of 200 μm using RHEOSOL-G5000 (by UBM Co., Ltd.).

Moreover, the volume resistances [Ω·cm] of the obtained transfer fixing members A to E were evaluated when pressures applied to the surfaces of the transfer fixing members A to E (surface pressures) were 0.05 kg/cm$^2$, 1.0 kg/cm$^2$ and 5.0 kg/cm$^2$, respectively.

These results are shown in Table 2.

TABLE 2

| | Storage elastic modulus E' ($\times 10^5$ Pa) | Loss elastic modulus E" ($\times 10^4$ Pa) | Receding contact angle | Volume resistance (Ω · cm) Surface pressure 0.05 kg/cm$^2$ | Surface pressure 2.0 kg/cm$^2$ | Surface pressure 5.0 kg/cm$^2$ |
|---|---|---|---|---|---|---|
| Transfer fixing member A | 20 | 1.0-14 | 53° | $10^{12}$ | $10^7$ | $10^4$ |
| Transfer fixing member B | 6.3 | 0.5-10 | 36° | insulated | $10^{11}$ | $10^5$ |
| Transfer fixing member C | 20 | 1.0-14 | 53° | insulated | insulated | insulated |
| Transfer fixing member D | 20 | 1.0-14 | 53° | $10^8$ | $10^5$ | $10^2$ |
| Transfer fixing member E | 93 | 1.0-46 | 59° | $10^8$ | $10^8$ | $10^8$ |

(3) Evaluation of Dot Reproducibility

Figure 2:
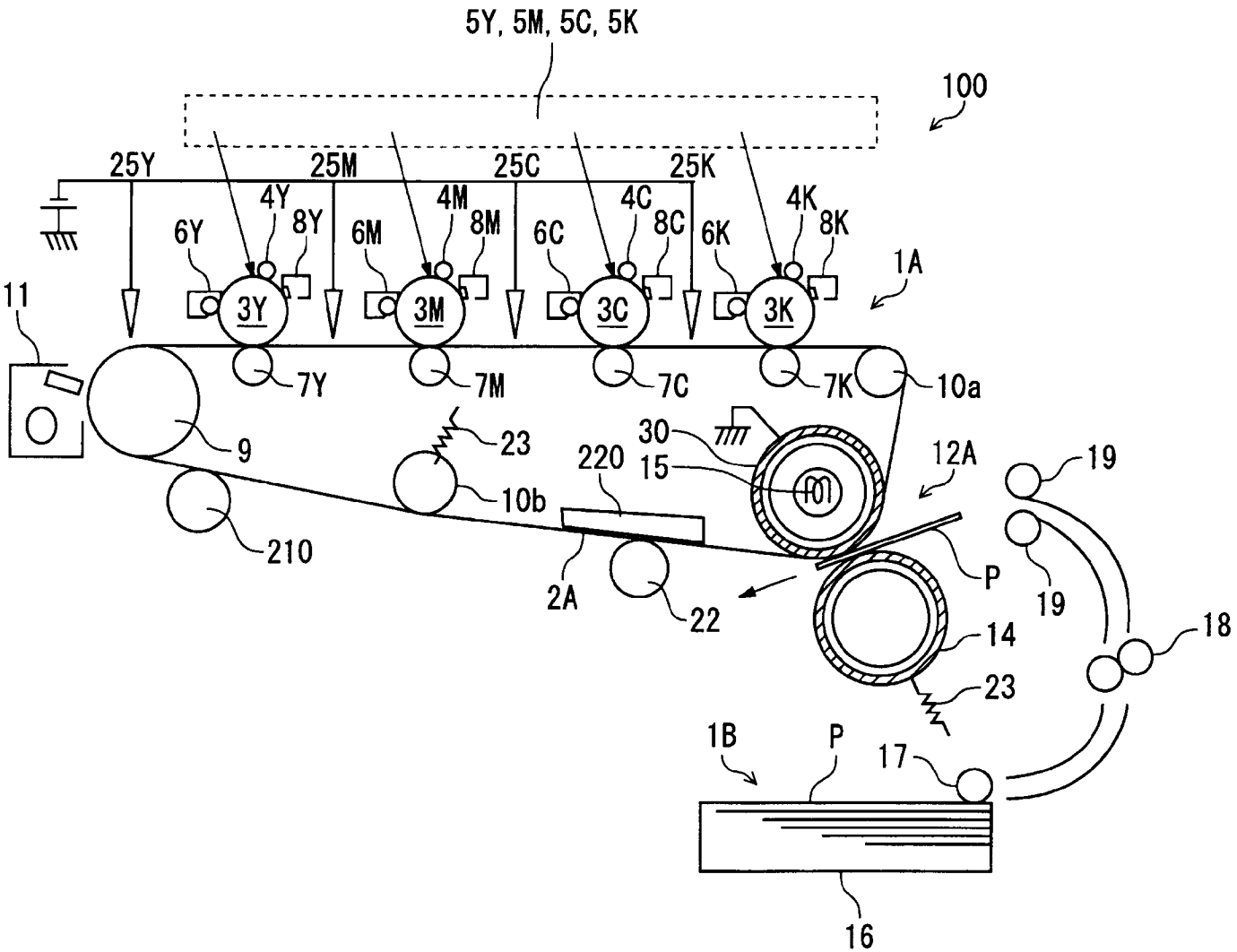
FIG. 2 is a schematic view showing an example of a configuration in the first embodiment of an image forming apparatus of the present invention.

The obtained transfer fixing members A to E were respectively mounted on a prototype of a color copier 100 as shown in FIG. 2 (the first embodiment of the present invention) and then dot reproducibility was evaluated. As a pressurizing roller 14, a SUS roller having necessary hardness and conductivity was used, and an intermediate transfer pressure which corresponded to a pressure applied to between each of the photoconductors 3Y, 3M, 3C, 3K and the transfer fixing belt 2A was set at 1.0 kg/cm$^2$, a transfer fixing pressure which corresponded to a pressure applied to between the transfer fixing belt 2A and the pressurizing roller 14 was set at 5.0 kg/cm$^2$ and a transfer fixing temperature was set at 150° C. As a paper, Classic White (smoothness of 17) was used.

The dot reproducibility was evaluated by the following manner: when a 2×2 dot image (600 dpi, 25%) was printed on 5,000 sheets. Among the printed sheets, some of them were sampled for every 10th sheets until the 100th sheet, thereafter, for every 100th sheets from the 101th sheet to the 1,000th sheet, and then for every 1,000th sheets from the 1,001th sheet to the 5,000th sheet. Thereafter, each dot reproducibility of a formed image was visually evaluated on the following criteria.

[Evaluation Criteria]

A: Dots were reproduced faithfully.

B: Nonuniform image and absence of dots were observed.

The results are shown in Table 3.

TABLE 3

| Type of transfer fixing member | Ex. 1 Transfer fixing member A | Ex. 2 Transfer fixing member B | Comp. Ex. 1 Transfer fixing member C | Comp. Ex. 2 Transfer fixing member D | Comp. Ex. 3 Transfer fixing member E |
|---|---|---|---|---|---|
| 10th sheets | A | A | A | B | B |
| 20th sheets | A | A | A | B | B |
| 30th sheets | A | A | B | B | B |
| 40th sheets | A | A | B | B | B |
| 50th sheets | A | A | B | B | B |
| 60th sheets | A | A | B | B | B |
| 70th sheets | A | A | B | B | B |
| 80th sheets | A | A | B | B | B |
| 90th sheets | A | A | B | B | B |
| 100th sheets | A | A | B | B | B |
| 200th sheets | A | A | B | B | B |
| 300th sheets | A | A | B | B | B |
| 400th sheets | A | A | B | B | B |
| 500th sheets | A | A | B | B | B |
| 600th sheets | A | A | B | B | B |
| 700th sheets | A | A | B | B | B |
| 800th sheets | A | A | B | B | B |
| 900th sheets | A | A | B | B | B |
| 1,000th sheets | A | A | B | B | B |
| 2,000th sheets | A | A | B | B | B |
| 3,000th sheets | A | A | B | B | B |
| 4,000th sheets | A | A | B | B | B |
| 5,000th sheets | A | A | B | B | B |

As a result, Examples 1 and 2 respectively using the transfer fixing members A and B achieved continuous stable dot reproducibility.

By contrast, in the Comparative Example 1 using the transfer fixing member C, the dot reproducibility was excellent until 20 sheets were printed, but thereafter the image print could not be obtained because problems occurred in intermediate transfer because the surface of the transfer fixing member was charged. Moreover, in the Comparative Example 2 using the transfer fixing member D, toner scattering occurred when transferring the image and offset occurred when transfer-fixing the image after 10 sheets were printed. In the Comparative Example 3 using the transfer fixing member E, the surface layer did not sufficiently follow a paper surface, thus absence of dots were observed after 10 sheets were printed.

Therefore, it was confirmed that a high-quality and high-stability image could be obtained even in a highlight area or high-density area in the image forming apparatus which achieves high-speed fixing and energy conservation by the transfer fixing device using the transfer fixing member of the present invention.

Thus far, the present invention is described with reference to the embodiments shown in the drawings. However, the present invention is not limited thereto, and it is understood that it can be changed by other embodiments, addition, modification and deletion within a range in which those skilled in the art can accomplish. Any embodiment is included within a range of the present invention, as long as the operation and effect of the present invention can be accomplished.

What is claimed is:

1. A transfer fixing member comprising:

a base; and an outermost surface layer composed of an elastic material in which a conductive material is dispersed, wherein a toner image on a toner image bearing member is transferred onto the transfer fixing member by making the toner image bearing member in contact with the transfer fixing member, and the toner image is transfer-fixed onto a recording medium by making the transfer fixing member in contact with the recording medium which is located between the transfer fixing member and a pressurizing member, and wherein when a pressure applied to a surface of the transfer fixing member by making the toner image bearing member in contact with the transfer fixing member upon transferring of the toner image onto the transfer fixing member is 0.2 kg/cm$^2$ to 2.0 kg/cm$^2$, the transfer fixing member has a volume resistance of $10^6$ Ω·cm or more to less than $10^{12}$ Ω·cm, and when a pressure applied to the surface of the transfer fixing member by making the transfer fixing member in contact with the recording medium which is located between the transfer fixing member and the pressurizing member upon transfer-fixing of the toner image onto the recording medium is 3.0 kg/cm$^2$ to 20 kg/cm$^2$, the transfer fixing member has a volume resistance of less than $10^6$ Ω·cm.

2. The transfer fixing member according to claim 1, wherein the outermost surface layer has a storage elastic modulus E' of $5.0\times10^5$ Pa to $5.0\times10^6$ Pa and a loss elastic modulus E" of $5.0\times10^3$ Pa to $1.5\times10^5$ Pa at 60° C. to 200° C.

3. The transfer fixing member according to claim 1, wherein the elastic material is any one of a fluorosilicone rubber and fluorocarbon siloxane rubber.

4. The transfer fixing member according to claim 1, wherein a wax component contained in an oilless toner has a receding contact angle with the outermost surface layer of 55° or less at a transfer fixing temperature.

5. A transfer fixing device comprising:

a transfer fixing member;

a heating unit configured to heat at least a surface of the transfer fixing member; and a pressurizing member configured to form a nip with the transfer fixing member, wherein the transfer fixing member comprises:

a base; and an outermost surface layer composed of an elastic material in which a conductive material is dispersed, wherein a toner image on a toner image bearing member is transferred onto the transfer fixing member by making the toner image bearing member in contact with the transfer fixing member, and the toner image is transfer-fixed onto a recording medium by making the transfer fixing member in contact with the recording medium which is located between the transfer fixing member and the pressurizing member, and wherein when a pressure applied to the surface of the transfer fixing member by making the toner image bearing member in contact with the transfer fixing member upon transferring of the toner image onto the transfer fixing member is 0.2 kg/cm$^2$ to 2.0 kg/cm$^2$, the transfer fixing member has a volume resistance of $10^6$ Ω·cm or more to less than $10^{12}$ Ω·cm, and when a pressure applied to the surface of the transfer fixing member by making the transfer fixing member in contact with the recording medium which is located between the transfer fixing member and the pressurizing member upon transfer-fixing of the toner image onto the recording medium is 3.0 kg/cm$^2$ to 20 kg/cm$^2$, the transfer fixing member has a volume resistance of less than $10^6$ Ω·cm.

6. An image forming apparatus comprising:

a transfer fixing device, wherein the transfer fixing device comprises:

a transfer fixing member;

a heating unit configured to heat at least a surface of the transfer fixing member; and a pressurizing member configured to form a nip with the transfer fixing member, wherein the transfer fixing member comprises:

a base; and an outermost surface layer composed of an elastic material in which a conductive material is dispersed, wherein a toner image on a toner image bearing member is transferred onto the transfer fixing member by making the toner image bearing member in contact with the transfer fixing member, and the toner image is transfer-fixed onto a recording medium by making the transfer fixing member in contact with the recording medium which is located between the transfer fixing member and the pressurizing member, wherein when a pressure applied to the surface of the transfer fixing member by making the toner image bearing member in contact with the transfer fixing member upon transferring of the toner image onto the transfer fixing member is 0.2 kg/cm$^2$ to 2.0 kg/cm$^2$, the transfer fixing member has a volume resistance of $10^6$ Ω·cm or more to less than $10^{12}$ Ω·cm, and when a pressure applied to the surface of the transfer fixing member by making the transfer fixing member in contact with the recording medium which is located between the transfer fixing member and the pressurizing member upon transfer-fixing of the toner image onto the recording medium is 3.0 kg/cm$^2$ to 20 kg/cm$^2$, the transfer fixing member has a volume resistance of less than $10^6$ Ω·cm, and wherein the toner image on the transfer fixing member is heated and melted by the heating unit, and then the melted toner image is simultaneously transferred and fixed on a recording medium which passes through the nip.

* * * * *